US006125678A

United States Patent [19]

Caporusso et al.

[11] Patent Number: 6,125,678

[45] Date of Patent: Oct. 3, 2000

[54] BENDING MACHINE TO WIND A STRIP OR THE LIKE INTO A SPIRAL

[75] Inventors: Alessandro Caporusso; Mario Caporusso, both of Piedimonte San Germano, Italy

[73] Assignee: C.M.L. Construzioni Meccaniche Liri S.r.l., San Germano, Italy

[21] Appl. No.: 09/409,904

[22] Filed: Oct. 1, 1999

[30] Foreign Application Priority Data

Oct. 1, 1998 [IT] Italy ..... RM98A0622

[51] Int. Cl.[7] ..... B21C 47/00

[52] U.S. Cl. ..... 72/147

[58] Field of Search ..... 72/146, 147, 145, 72/149, 150, 152

[56] References Cited

U.S. PATENT DOCUMENTS

| | | | |
|---|---|---|---|
| 2,929,135 | 3/1960 | Cromberg et al. | 72/146 |
| 3,662,575 | 5/1972 | Zmuda | 72/21 |
| 5,632,174 | 5/1997 | Hunter | 72/129 |

FOREIGN PATENT DOCUMENTS

| | | | |
|---|---|---|---|
| 2837946 | 12/1979 | Germany | 72/146 |
| 662220 | 5/1979 | U.S.S.R. | 72/148 |

*Primary Examiner*—Rodney A. Butler
*Attorney, Agent, or Firm*—Young & Thompson

[57] ABSTRACT

A bending machine to wind a strip or the like into a spiral comprising a mandrel (2), a bending tool (3), including a grip portion (32) of an end (50) of a strip (5) and a supporting, guiding and counteracting element (4) on a table (1) of the bending machine is disclosed. The bending tool (3) further comprises a plurality of modular elements (60, 61, 62, 63, 64 . . . ) consecutively so jointed to be relatively movable according to predetermined plane rotations, connected to the grip portion (32), so that, in the rotation of the mandrel (2), the plurality of modular elements roll up on the grip portion (32), with the strip (5) being interposed, so that the path of radially internal and external surfaces of said modular elements are spiral and continuous. The supporting element (4) includes a friction roller-holder lever (40), which can be operated by a vise.

15 Claims, 3 Drawing Sheets

41
42
40
4
83
1
82
49
48
47
48
43
81
80
45
46
73
72
44

BENDING MACHINE TO WIND A STRIP OR THE LIKE INTO A SPIRAL

BACKGROUND OF THE INVENTION

1. Field of the Invention

This invention relates to a bending machine to wind a strip or the like into a spiral. Usually, a spiral-bending machine has a mandrel supporting a bending tool designed to receive and retain an end of a strip or the like to be bent and at least a supporting or counteracting element of a strip to allow its permanent deformation. Here and below the term of "mandrel" means in proper sense the shaft transmitting the movement to a workpiece.

2. Description of the Related Art

In a known spiral bending machine, the bending tool consists generally of a circular plate rigidly supporting on its external side a projection shaped according to a portion of spiral. In order to obtain a spiral, for example, of three turns, therefore a complete set of bending tools of the above mentioned type is necessary, comprising for example a first bending tool for the first turn near the pole, a second bending tool for the second tool and so on. A roller of a supporting and counteracting element rigidly supported to the machine table is operatively connected to the first bending tool, while a second roller, being part of the same supporting element but fitted on the table in a diametrically opposed position, is connected to the second bending tool. Just the same for the third turn. Naturally this kind of spiral-bending machine requires, for making only three turns, that three bending tools are fitted on and removed from the mandrel and correspondingly the supporting and counteracting element is fitted on and removed from three different positions on the machine table. In addition to a waste of time, one must consider that the operation needs of a certain capacity by a worker. He must estimate correctly in which point he has to stop the bending operation by means of a bending tool and continue it by means of a subsequent bending tool without suffering from problems of interference of the workpiece already partially bent by the bending tool useful for carrying on the spiral machining. In another spiral-bending machine known the bending tool consists of a first bending tool member connected to a mandrel, acting as a grip element for the strip to be bent, and of second bending tool member able to be arranged continuously with the first bending tool member to form a complete turn or a little more. The second bending tool member is shaped "as a comma", having a thickened portion, through which it is pivoted on the first bending tool member, and thinning with an arc toward the free end. The second bending tool member is provided in various conformations, to which different patterns of the portion of spiral obtainable correspond. As a whole, the bending tool of this second spiral-bending machine is not so rigid to allow metal workpieces of different material and thickness to be worked in a same satisfactory way, unless the worker runs the risk of breaking the bending tool. Further, such a bending tool enables the spiral-bending for a little more than a turn, as it is not possible to add other elements overhanging on the second bending tool member.

SUMMARY OF THE INVENTION

A main object of this invention is therefore to overcome the drawbacks of the prior art spiral-bending machines.

In particular, an object of the invention is to enable a spiral-bending operation with permanent deformation of a strip or the like, without requiring any replacement of both the bending tool or the cooperating element adapt to support a workpiece and counteract.

Another object of the invention is to enable a bending machining according to any spiral desired continuously, i.e. without stops.

Yet another object of the invention is to enable a spiral-bending operation of any strip or the like, independently of its thickness and the material of which it is made.

A further object of the invention is to enable a machining in which the bending operation is carried on in safe conditions for the worker, by virtue of the reliable retention of the strip being worked.

Yet a further object of the invention is to make easier to fit into the bending tool the strip to be bent and to enable a convenient removal thereof.

In addition an object of the invention is to enable any bending machine, such as an arching machine, a twisting machine, etc. to operate according to the way of a spiral-bending machine, since the spiral-bending machine can constitute an attachment which may be applied to any bending machine if required.

A further object of the invention is to enable a substantially automatic bending operation depending upon the number of turns to be made.

These objects are achieved by the present invention which provides, such as defined and characterised broadly in the first one of the accompanying claims and in its more meaningful particular embodiments in the subsequent claims, a bending machine to wind a strip or the like into a spiral comprising a mandrel, a bending tool, including, in its connection part adapted to the connection with the mandrel, a grip portion gripping an end of a strip or the like to be bent, and at least a supporting, guiding and counteracting element on a table of the bending machine for the permanent deformation of the strip or the like, characterised in that said bending tool further comprises:

a plurality of modular elements consecutively so jointed to be relatively movable according to predetermined plane rotations;

a junction link connecting said plurality of modular elements to said grip portion; said junction link having a wide interval of rotation both with respect the grip portion and with respect to the plurality of modular elements; during the rotation of the mandrel according to the direction of machining, said plurality of modular elements rolling up on said grip portion, with the strip or the like being interposed, so that the path of radially internal and external surfaces of said modular elements are spiral and continuous;

said supporting, guiding and counteracting element includes a roller-holder lever, pivoted on said table of the bending machine and bearing, pivoted transversely to the free end of the roller-holder, a supporting, guiding and counteracting roller for the strip or the like so that said lever is rotated by the strip or the like, along a determinate angular travel, in the same direction of rotation of said mandrel.

BRIEF DESCRIPTION OF THE DRAWINGS

The invention is described more in detail below, only by example but not in limiting way, in connection with a preferred embodiment thereof with reference to the accompanying drawing, in which.

DETAILED DESCRIPTION OF THE PREFERRED EMBODIMENT

In the figures there are designed as 1 a table of the bending machine, as 2 a mandrel of the bending machine, as 3 a bending tool and as 4 a supporting, guiding and counteracting element.

Figure 1:
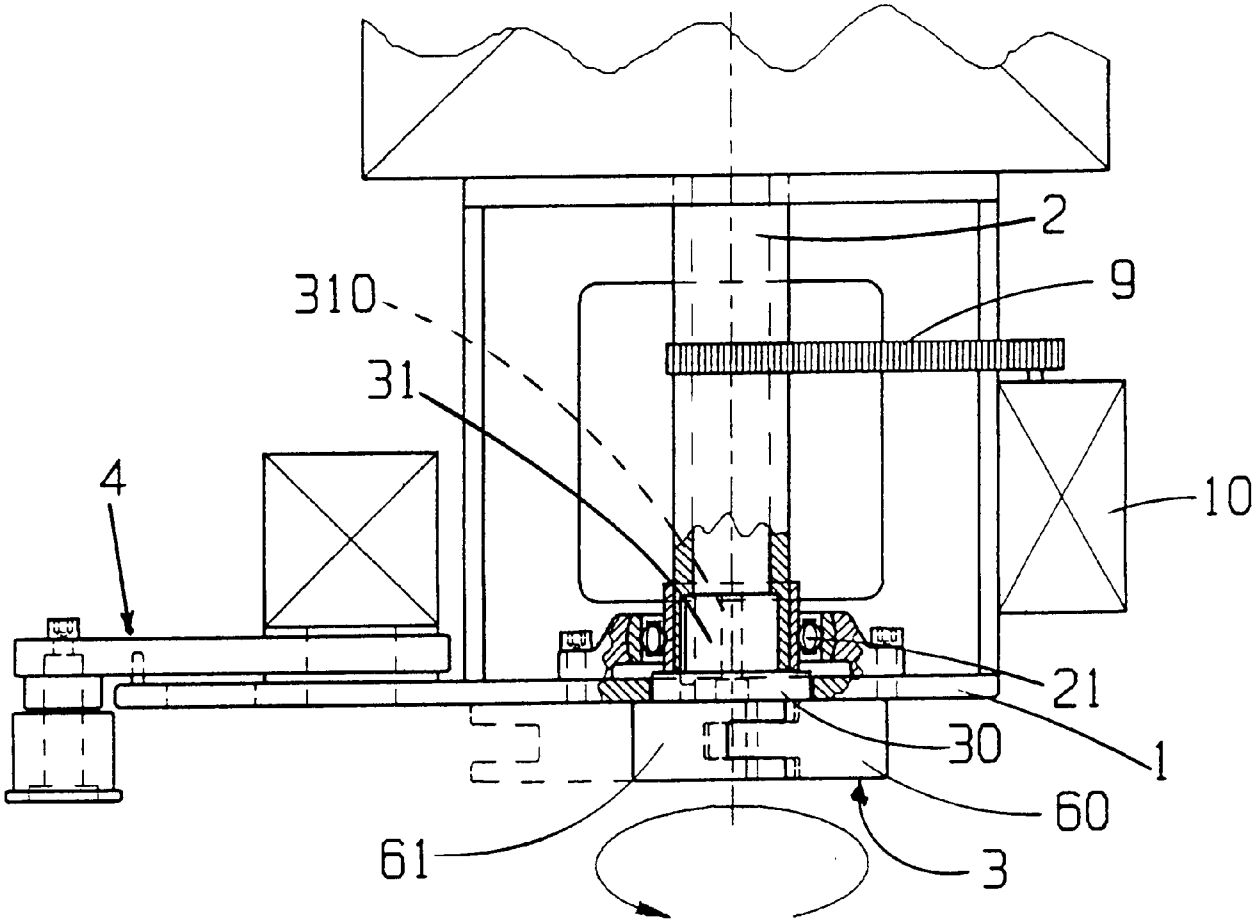
FIG. 1 is a fragmentary top view, partially cross-sectioned, of a bending machine according to this invention.
Figure 2:
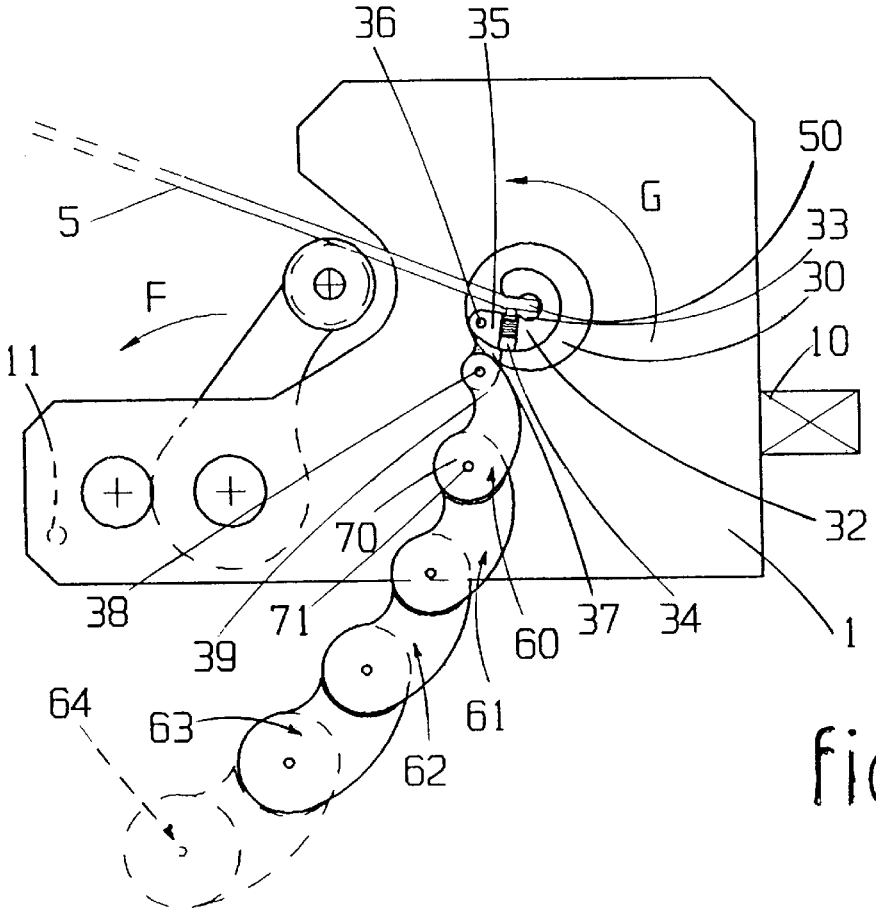
FIG. 2 is a vertical front view of the bending machine according to this invention in an initial machining step.
Figure 3:
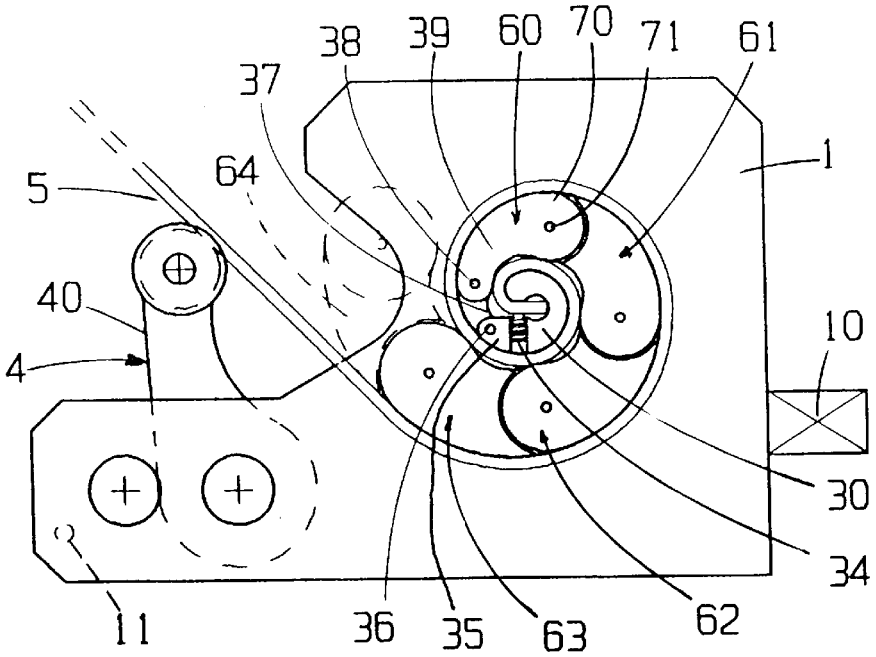
FIG. 3 is a vertical front view of the bending machine according to this invention in an intermediate or final machining step.
Figure 4:
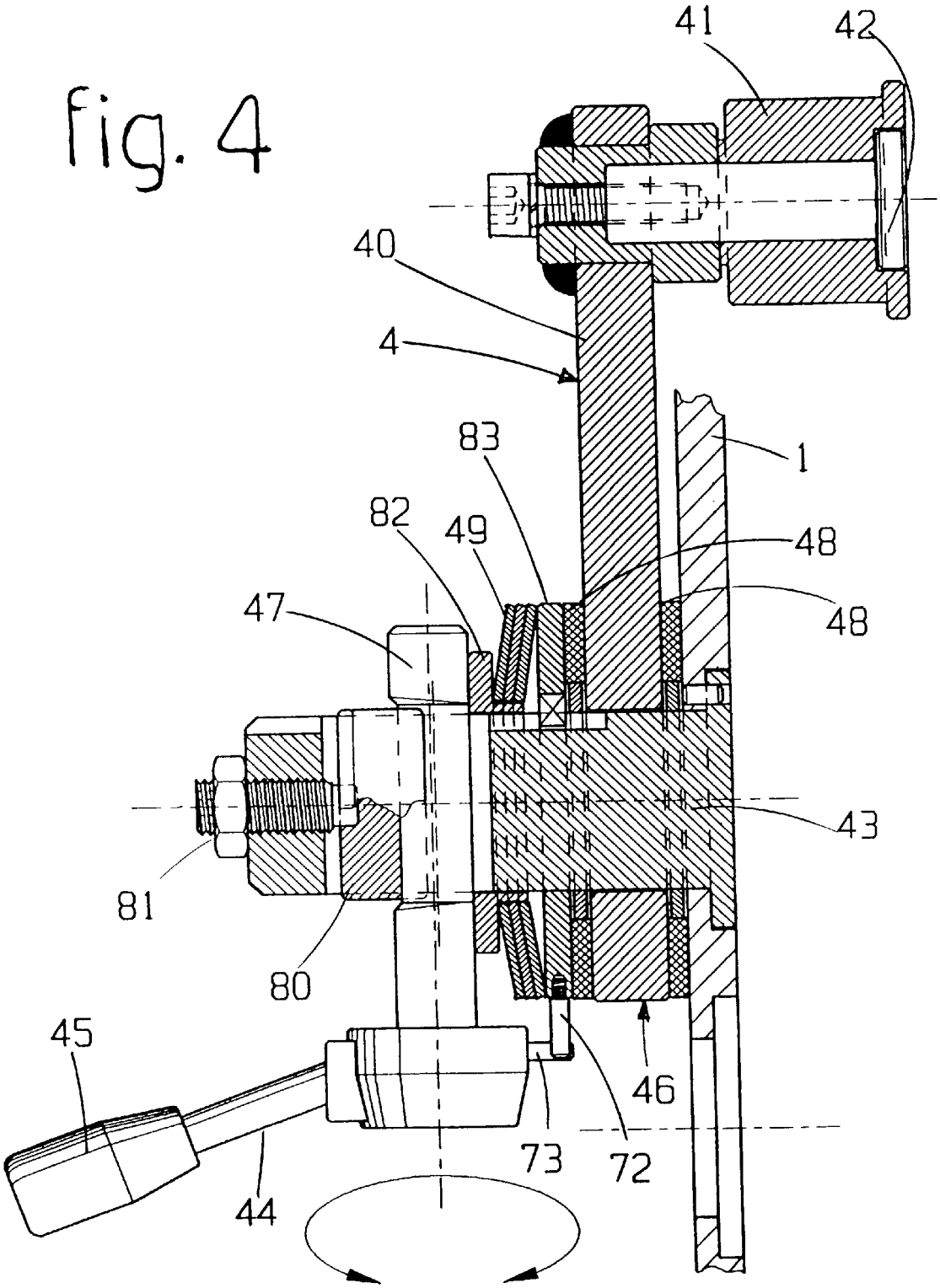
FIG. 4 is an enlarged cross-section view of a supporting, guiding and counteracting element of the bending machine according to this invention.

With reference to FIGS. 1 to 3, there are shown the table 1, which may function as a supporting attachment of a spiral-bending machine when a mandrel of universal bending machine, an arching machine or other bending machine, etc. is used as mandrel 2, or may constitute an integral part of a specific spiral-bending machine.

The bending tool 3 has a cylindrical body 30 provided with a connection part 31, on the one side thereof, connecting the bending tool 3 to the mandrel 2 (FIG. 1), which is supported through a bearing 21 to the table 1, and the other side with a grip portion 32, gripping the end of a strip 5 or the like to be bent. The connection part 31 comprises a hollow cylindrical portion 310 provided with fastening means to secure the connection part 31 to the mandrel 2, such as for example a threaded coupling between the bending tool 3 and the mandrel 2, or a spline made on the external surface of the connection part 31 for a key joint.

The grip portion 32 is essentially a channel having a central notch 33 (FIGS. 2, 3) designed to receive an end portion 50 of the strip 5. The grip portion 32 has a retaining means of the end portion 50, such as for example a security dowel 34 to be screwed against the same portion.

The grip portion 32 extends to a fork portion 35 which is crossed by a through pin 36 parallel to the axis of the mandrel. Pivoted on the pin 36 is a junction link 37, which is connected through another pin 38 to a fork portion 39 of a first modular element 60 of a plurality of modular elements 60, 61, 62, 63, 64 . . . consecutively so jointed to be relatively movable according to predetermined plane rotations. The junction link 37 connecting the plurality of modular elements to the grip portion 32 has a wide interval of rotation, for example more than 180° both with respect the grip portion and with respect to the plurality of modular elements, in order to make easier to insert the strip 5 into the portion grip 32 and prevent the same strip from interfering with the bending tool 3.

The modular element 60, at other side far from its fork portion 39, has a similar fork portion 70 for the connection through a pin 71 of the modular element 60 to the modular element 61. Alternatively, this arrangement of male link coupling could be a female link coupling by consequently inverting the homologous coupling parts. The modular elements 61, 62, 63, 64 . . . and, if any, others (not shown) have a solid portion as a relative rotation seat of the preceding modular element and a fork portion for the relative rotation of the subsequent modular element.

The modular elements act as a flat link chain having parallel pins. The relative rotation among the elements is selected so that the elements take varying positions between a free hanging position shown in FIG. 2 in an initial step of the bending operation and a final position. In the last position the bending tool 3 is completely rolled up on itself, in particular on its grip portion 32, with the strip 5 being interposed, so that no empty space between the strip and the bending tool is left. Thus the maximum stiffness is achieved in the working step. The arrangement of the modular elements can be obtained in succession by means of joint elements different from the parallel pin joints.

The longitudinal section of the modular elements 60, 61, 62, 63, 64 . . . is shaped substantially as a bean having form and dimensions corresponding to the particular spiral according to which the strip or the like must be bent. In particular said modular elements are so made that the path of their radially internal and external surfaces are without a break in order to obtain a continuous curvature on the strip 5 and cause no deformation on the internal and external surfaces.

The supporting, guiding and counteracting element 4 includes a roller-holder lever 40, pivoted on the table 1 of the spiral-bending machine in a seat selected among a multiplicity of seats which are provided at different distances from the mandrel 2.

A roller 41 supporting, guiding and counteracting the strip or the like being worked is pivoted transversely to the free end of the lever 40 in its portion 42. The roller-holder lever 40 is rotated in the direction of an arrow F (FIG. 2) of the strip or the like for a determinate angular travel (shown in FIGS. 2 and 3), in the same direction of rotation of the mandrel shown by an arrow G (FIG. 2).

The roller-holder lever 40 is pivoted on the shaft 43 of a vice provided with an eccentric control rod 44, having a handle 45, and a coaxial clutch unit 46. An eccentric 47 acts transversely on the clutch unit 46 constituted by at least a friction disk 48, 48 (two in the drawing) side by side with the roller-holder 40. Counteracting springs 49, preferably Belleville washers, having as a seat a coaxial flange 82 abutting against the eccentric 47 and a spacer 83 fitted on the shaft 43 in a sliding and not rotating manner, are interposed between the eccentric 47 and a friction disk 48. Further, the vice is provided with spring calibration means in order to set the friction torque matching the permanent deformation of the strip or the like. Said spring calibration means comprise a spacer 80 cooperating with a screw and adjustment nut 81 to charge the eccentric 47 of the control rod.

Further, stop means 72, 73 of the vise, stopping the rotation of the control rod 45 in mutual relationship with the operation of the eccentric 47 are fitted on said spacer 83 and, respectively, on said eccentric rod 44.

In the spiral-bending machine according to the invention the mandrel 2 is controlled in its rotation by its control member, for example a control pedal (not shown in figures) or, alternatively, the mandrel 2 is a mandrel of a multipurpose bending machine.

According to the invention the mandrel is connected to a screw and nut screw device 10 for stop microswitches (FIG. 1) through a toothed belt 9 running on a pair of gear wheels. Instead of said device 10, another automatic control device can be provided.

When the spiral-bending machine is used, an end 50 of the strip 5 is put in the notch 33 of the grip portion 32 of the bending tool 3 which is freely hanging. The strip 5 rests on the supporting element 4, in particular on its roller 41, that has been tightened by the eccentric control rod 44. The adjustment nut 81 of the eccentric 47 is set so to charge the spring 49 of the clutch unit 46 according to the stiffness of the strip to be worked. Then the mandrel 2 is rotated in the direction of the arrow G. While the bending tool 3 is rolled up on the grip portion 32, it causes the strip 5 to be rolled up on the grip portion 32 and be close to the same, "forming only a body". At the same time the strip 5 counteracts the supporting element 4 which gradually moves applying a constant resistance, according to the arrow F in the final position shown in FIG. 3.

The operation may be executed automatically as above mentioned if the controls to begin and stop the bending operation are interlocked with the stop microswitch device 10.

When the operation is complete, the lever 40 of the supporting element 4 may be loosened by the eccentric control rod 44 to release the strip 5 from the machine. The lever 40 can rotate along an arc until its position is essentially horizontal, as defined by an abutment 11 (FIGS. 2, 3).

The invention so conceived is liable to changes and modification without departing from the scope of the same innovative concept.

What is claimed is:

1. A bending machine for winding a strip of stock material into a spiral comprising a mandrel (2), a bending tool (3), connected to the mandrel and having a grip portion (32) for gripping an end (50) of a strip (5) to be bent, and at least one supporting, guiding and counteracting element (4) on a table (1) of the bending machine for permanent deformation of the strip (5), said bending tool (3) further comprising:

a plurality of modular elements (60, 61, 62, 63, 64 . . . ) consecutively jointed and relatively movable according to predetermined plane rotations;

a junction link (37) connecting said plurality of modular elements to said grip portion (32); said junction link being pivotable both with respect to the grip portion and with respect to the plurality of modular elements;

wherein during rotation of the mandrel (2), said plurality of modular elements (60, 61, 62, 63, 64 . . . ) roll up on said grip portion (32), with the strip (5) being interposed, so that the path of radially internal and external surfaces of said modular elements (60, 61, 62, 63, 64 . . . ) is spiral and continuous;

said supporting, guiding and counteracting element (4) including a roller-holder lever (40), pivoted on said table (1) of the bending machine and bearing, pivoted transversely to the free end of the roller-holder (40), a supporting, guiding and counteracting roller (41) for the strip (5) wherein said lever (40) is rotated by the strip (5), along a predetermined path, in the same direction of rotation of said mandrel (2).

2. Bending machine according to claim 1, wherein said junction link (37) pivots over a range of more than 180°.

3. Bending machine according to claim 1, wherein said roller-holder lever (40) is pivotable on said table (1) in a seat selected among a multiplicity of seats which are provided at different distances from said mandrel (2).

4. Bending machine according to claim 1, wherein said roller-holder lever (40) is pivoted on the shaft (43) of a vise provided with an eccentric control rod (44) and a coaxial clutch unit (46), an eccentric (47) acting transversely on said clutch unit (46) constituted by at least one friction disk (48) side by side with said roller-holder (40); on said spacer (83) and, respectively, on said eccentric rod (44) there being fitted counteracting springs, spring calibration means for setting a friction torque corresponding to a permanent deformation of the strip and stop means for stopping the rotation of the control rod in mutual relationship with the operation of the eccentric (47).

5. Bending machine according to claim 1, wherein said grip portion (32) of the bending tool (3) comprises a retaining means of the strip (5) in the form of a security dowel (34) to be screwed against the same strip (5) to be worked.

6. Bending machine according to claim 1, wherein said modular elements are interconnected by cylindrical parallel pins.

7. Bending machine according to claim 1, wherein said modular elements have a longitudinal section shaped substantially as a bean having form and dimensions corresponding to the spiral according to which the strip is to be bent.

8. Bending machine according to claim 1, wherein the mandrel is controlled in its rotation by a control pedal of the spiral-bending machine.

9. Bending machine according to claim 1, wherein the mandrel is interconnected to a mandrel of a multipurpose bending machine.

10. Bending machine according to claim 1, wherein said mandrel is connected to a screw and nut screw device (10) for stop microswitches through a toothed belt (9).

11. Bending machine according to claim 4, wherein said spring calibration means comprise a spacer (80) cooperating with a screw and adjustment nut (81) to charge the eccentric (47) of the control rod (44) against said counteracting springs.

12. Bending machine according to claim 4, wherein said counteracting springs are constituted by Belleville washers (49) interposed between said eccentric (47) and said clutch unit (46).

13. Bending machine according to claim 4, wherein said stop means of the rotation of said control rod comprise abutment elements (72, 73) provided in said clutch unit (46) and, respectively, on said control rod (44).

14. A bending machine for bending a strip of stock material into a flat spiral, said bending machine comprising a rotary mandrel and a composite bending tool secured to said rotary mandrel; said composite bending tool comprising a gripping portion for receiving a forward end of the strip of stock material to be bent, and a plurality of pivotally interconnected links, one of said links being pivotally connected to said gripping portion, wherein rotation of said mandrel about its axis of rotation causes bending of the strip of stock material, with each successive pivotal link coming into contact with said strip of stock material, thereby to continue bending said strip of stock material along a progressively increasing radius of curvature.

15. The bending machine according to claim 14, wherein each of said plurality of links comprises a curved working surface, and wherein each link more distant from said gripping portion has a radius of curvature greater than an adjacent link nearer said gripping portion.

* * * * *